US009520255B2

(12) United States Patent
Kawamura

(10) Patent No.: US 9,520,255 B2
(45) Date of Patent: Dec. 13, 2016

(54) CONNECTION STRUCTURE OF ELECTRONIC COMPONENT AND TERMINAL METAL FITTINGS

(71) Applicant: Yazaki Corporation, Tokyo (JP)

(72) Inventor: Yukihiro Kawamura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/003,186

(22) Filed: Jan. 21, 2016

(65) Prior Publication Data

US 2016/0141131 A1 May 19, 2016

Related U.S. Application Data

(63) Continuation of application No. PCT/JP2014/072270, filed on Aug. 26, 2014.

(30) Foreign Application Priority Data

Aug. 30, 2013 (JP) ..... 2013-179117

(51) Int. Cl.
*H01H 50/14* (2006.01)
*H01R 9/24* (2006.01)
*H01H 50/04* (2006.01)

(52) U.S. Cl.
CPC ..... *H01H 50/14* (2013.01); *H01H 50/04* (2013.01); *H01R 9/24* (2013.01); *H01H 50/048* (2013.01)

(58) Field of Classification Search
CPC .... H01H 50/14; H01H 50/047; H01H 50/048; H01H 50/04; H01H 45/02; H01H 45/14; H01H 9/02; H01H 2009/0285; H01R 13/684; H01R 13/68
See application file for complete search history.

(56) References Cited

U.S. PATENT DOCUMENTS 3,846,734 A * 11/1974 Pauza ..... H05K 7/1076 174/541
3,912,984 A * 10/1975 Lockhart, Jr. ..... H05K 1/141 174/541

(Continued)

FOREIGN PATENT DOCUMENTS

JP 44-31387 Y1 12/1969
JP 63-146939 U 9/1988

(Continued)

OTHER PUBLICATIONS

International Search Report of PCT/JP2014/072270 dated Oct. 7, 2014 [PCT/ISA/210].

*Primary Examiner* — Ross Gushi
(74) *Attorney, Agent, or Firm* — Sughrue Mion, PLLC

(57) ABSTRACT

A connection structure of an electronic component and terminal metal fittings includes a relay including a relay body and a plurality of terminals, terminal metal fittings mating with the terminals, and a holding member. The terminals have end portions facing side surfaces of the relay body, and their leading ends are positioned closer to a top surface side than a bottom surface of the relay body. At a side surface, a first terminal and a second terminal that is more rigid than the first terminal are disposed. The holding member includes a component body accommodating portion, a first terminal accommodating portion, and a second terminal accommodating portion. A gap dimension between the first terminal and an insertion slot of the first terminal accommodating portion is larger than a gap dimension between the second terminal and an insertion slot of the second terminal accommodating portion.

7 Claims, 7 Drawing Sheets

(56) References Cited

U.S. PATENT DOCUMENTS 4,018,494 A * 4/1977 Scheingold ..... H05K 7/1076 439/330
4,045,105 A * 8/1977 Lee ..... H05K 7/1069 439/69
4,080,026 A * 3/1978 Gianni ..... H05K 7/1038 257/686
4,116,519 A * 9/1978 Grabbe ..... H05K 7/1046 439/69
4,192,565 A * 3/1980 Gianni ..... H05K 7/1038 439/381
4,266,840 A * 5/1981 Seidler ..... H05K 7/1007 439/264
4,349,238 A * 9/1982 Showman ..... H05K 7/1007 439/264
4,356,532 A * 10/1982 Donaher ..... H05K 1/141 174/541
4,364,620 A * 12/1982 Mulholland ..... H05K 7/023 439/206
4,406,508 A * 9/1983 Sadigh-Behzadi .. H05K 7/1046 439/526
4,417,777 A * 11/1983 Bamford ..... H05K 7/1038 439/381
4,491,378 A * 1/1985 Crawford ..... H05K 7/1007 439/264
4,539,621 A * 9/1985 Currier ..... H05K 7/103 361/212
4,616,895 A * 10/1986 Yoshizaki ..... H05K 7/1069 439/330
4,630,875 A * 12/1986 Korsunsky ..... H05K 7/1007 439/152
4,637,670 A * 1/1987 Coller ..... H05K 7/1046 439/180
4,645,279 A * 2/1987 Grabbe ..... H01R 9/091 439/68
4,645,943 A * 2/1987 Smith, Jr. ..... G06F 1/30 307/150
4,696,525 A * 9/1987 Coller ..... H05K 7/1046 439/69
4,710,134 A * 12/1987 Korsunsky ..... H05K 7/1007 439/264
4,729,739 A * 3/1988 Coffee ..... H05K 7/1046 439/71
4,737,884 A * 4/1988 Wada ..... H01L 23/057 174/555
4,746,299 A * 5/1988 Matsuoka ..... H01R 12/7076 439/525
4,769,345 A * 9/1988 Butt ..... H01L 23/04 174/50.51
4,796,083 A * 1/1989 Cherukuri ..... H01L 23/057 257/666
4,883,428 A * 11/1989 Tonooka ..... H05K 7/1092 361/736
4,934,944 A * 6/1990 Kozel ..... H05K 7/1046 439/68
RE33,268 E * 7/1990 Grabbe ..... H01R 9/091 439/525
4,941,832 A * 7/1990 Korsunsky ..... H05K 7/1046 439/515
4,961,106 A * 10/1990 Butt ..... H01L 23/057 257/687
4,968,259 A * 11/1990 Korsunsky ..... H05K 7/1023 206/724
4,976,624 A * 12/1990 Ishizuka ..... H05K 7/1076 439/70
5,007,844 A * 4/1991 Mason ..... H05K 3/301 439/68
5,007,845 A * 4/1991 Grabbe ..... H05K 7/1023 439/330
5,022,869 A * 6/1991 Walker ..... H05K 7/1023 439/526
5,192,215 A * 3/1993 Grabbe ..... H05K 7/1023 439/525
5,273,442 A * 12/1993 Laub ..... H05K 7/1023 439/526
5,288,236 A * 2/1994 McIntyre ..... H05K 13/0486 439/330
5,605,464 A * 2/1997 Ikesugi ..... G01R 1/0408 439/68
5,733,132 A * 3/1998 Belopolsky ..... H05K 7/1023 439/331
6,231,370 B1 * 5/2001 Morin ..... H01R 12/57 361/807
7,053,480 B2 * 5/2006 Hauser ..... H01L 23/49555 257/631
7,511,368 B2 * 3/2009 Jordan ..... H01R 13/7195 257/684
8,228,143 B2 * 7/2012 Takano ..... H01H 50/047 335/202
9,293,276 B2 * 3/2016 Kawamura ..... H01R 33/975
9,320,162 B2 * 4/2016 Kawamura ..... H05K 5/0217
9,378,912 B2 * 6/2016 Kawamura ..... H01R 13/73
9,384,914 B2 * 7/2016 Kawamura ..... H01R 9/2458
9,393,919 B2 * 7/2016 Sato ..... B60R 16/0239
2007/0010123 A1 * 1/2007 Ikeda ..... H01H 50/048 439/374
2013/0043971 A1 * 2/2013 Chen ..... H01H 85/2045 337/205
2014/0106580 A1 * 4/2014 Sato ..... B60R 16/0239 439/76.2
2015/0155121 A1 * 6/2015 Kawamura ..... H01H 50/048 439/722
2015/0163943 A1 * 6/2015 Kawamura ..... H01H 50/048 361/728
2015/0380181 A1 * 12/2015 Kawamura ..... H01R 9/2458 200/293
2015/0380182 A1 * 12/2015 Kawamura ..... H01H 45/02 200/293
2015/0382497 A1 * 12/2015 Kawamura ..... B60R 16/0238 361/728
2016/0006159 A1 * 1/2016 Kawamura ..... H01R 9/2425 439/540.1
2016/0006228 A1 * 1/2016 Kawamura ..... H02G 3/086 361/657
2016/0020049 A1 * 1/2016 Kawamura ..... H01R 13/73 200/51 R
2016/0020050 A1 * 1/2016 Kawamura ..... H01R 13/642 200/238
2016/0027599 A1 * 1/2016 Kawamura ..... H01R 13/113 335/202
2016/0049779 A1 * 2/2016 Kawamura ..... H02G 3/081 174/541
2016/0049780 A1 * 2/2016 Kawamura ..... H02G 3/18 174/541
2016/0050777 A1 * 2/2016 Kawamura ..... H05K 5/0217 174/549
2016/0050779 A1 * 2/2016 Kawamura ..... H02G 3/18 361/732
2016/0118754 A1 * 4/2016 Kawamura ..... H01R 9/24 439/620.21
2016/0141131 A1 * 5/2016 Kawamura ..... H01R 9/24 335/202

FOREIGN PATENT DOCUMENTS

JP 2010-016943 A 1/2010
JP 2010-221787 A 10/2010

* cited by examiner

CONNECTION STRUCTURE OF ELECTRONIC COMPONENT AND TERMINAL METAL FITTINGS

CROSS-REFERENCE TO RELATED APPLICATION

This application is a continuation application of International Application PCT/JP2014/072270, filed on Aug. 26, 2014, and designating the U.S., the entire contents of which are incorporated herein by reference.

BACKGROUND OF THE INVENTION

1. Field of the Invention

The present invention relates to a connection structure of an electronic component and terminal metal fittings.

2. Description of the Related Art

FIG. 7 is a perspective view of a conventional relay. FIG. 8 is a bottom view of the relay illustrated in FIG. 7. FIG. 9 is a sectional view of a connection structure of the relay illustrated in FIG. 7 and terminal metal fittings. For the convenience of illustration, FIG. 9 illustrates a relay body 302 only in a side view.

As illustrated in FIGS. 7 and 8, this conventional relay 301 includes the relay body 302 having a rectangular parallelepiped outer shape, and a plurality of plate-like terminals 303*a* and 303*b* protruding from a bottom surface 302*b* of the relay body 302 to mate with terminal metal fittings 304 (illustrated in FIG. 9).

The terminals 303*a* conduct electric current to a coil inside the relay body 302. The terminals 303*b* are terminals to which a higher voltage or a larger current than the terminals 303*a* is applied. The terminals 303*b* have a larger width and thickness than the terminals 303*a*.

As illustrated in FIG. 9, a connection structure 307 of the conventional relay and the terminal metal fittings includes the relay 301 illustrated in FIGS. 7 and 8, the terminal metal fittings 304 mating with the terminals 303*a* and 303*b* of the relay 301, and a holding member 306 to which the relay 301 and the terminal metal fittings 304 are mounted. The terminal metal fittings 304 are connected to end portions of wires 305.

The holding member 306 is made of a synthetic resin. The holding member 306 includes a plurality of accommodating portions 361 for accommodating the terminals 303*a* and 303*b* and the terminal metal fittings 304, and lances 362 provided in the accommodating portions 361 to engage the terminal metal fittings 304.

Japanese Patent Application Laid-open No. 2010-221787 discloses an electrical connection box for automobiles that has the connection structure 307 of the relay and the terminal metal fittings described above.

The conventional connection structure 307 of the relay and the terminal metal fittings fails to allow the terminals 303*a* and 303*b* to enter the corresponding accommodating portions 361 in a straight position, not in a sloping position, when the relay 301 is attached to the holding member 306. This situation may cause distortion or damage to the terminals 303*a* and 303*b* in some cases. In particular, the terminals 303*a*, which are less rigid than the terminals 303*b*, are more likely to suffer distortion or damage.

The terminals 303*a* of the relay 301 differ from the terminals 303*b* in rigidity by their different width and thickness. Some other relays include a plurality of terminals that have different rigidity by their different materials. Such relays may also suffer distortion or damage to their less rigid terminals as in the case of the relay 301.

A connection structure of an electronic component other than the relay 301 and terminal metal fittings may cause distortion or damage to the terminals if the electronic component is attached to the holding member with its inclined posture.

SUMMARY OF THE INVENTION

It is an object of the present invention to provide a connection structure of an electronic component and terminal metal fittings that can prevent distortion or damage to terminals of the electronic component when the electronic component is attached to a holding member.

In order to achieve the above mentioned object, a connection structure of an electronic component and terminal metal fittings according to one aspect of the present invention includes an electronic component including a component body having a rectangular parallelepiped outer shape, and a plurality of terminals that have end portions facing side surfaces of the component body, the end portions having leading ends positioned closer to a top surface side than a bottom surface of the component body; a plurality of terminal metal fittings configured to mate with the corresponding terminals; and a holding member in which the electronic component and the plurality of terminal metal fittings are accommodated, wherein two or more terminals of the terminals facing a side surface of the component body include a first terminal and a second terminal that is more rigid than the first terminal, the holding member includes a component body accommodating portion that accommodates the component body, and terminal accommodating portions that accommodate the end portions of the terminals and the terminal metal fittings, and a gap dimension between the first terminal and an insertion slot of a first terminal accommodating portion in which the first terminal is accommodated is larger than a gap dimension between the second terminal and an insertion slot of a second terminal accommodating portion in which the second terminal is accommodated.

According to another aspect of the present invention, in the connection structure, it is desirable that the plurality of terminals protrude from the component body and bend in right angles.

According to still another aspect of the present invention, in the connection structure, it is desirable that a width of the second terminal is formed larger than a width of the first terminal.

According to still another aspect of the present invention, in the connection structure, it is desirable that the second terminal is made of a material that is more rigid than a material of the first terminal.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
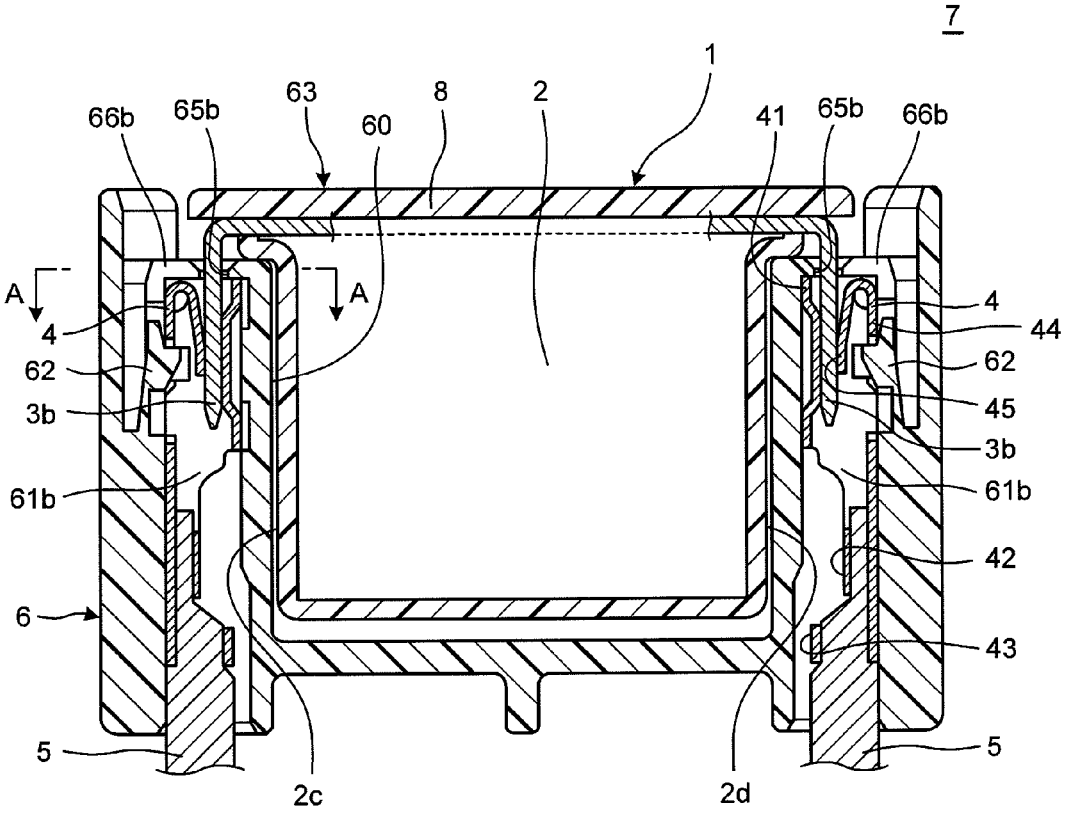
FIG. 1 is a sectional view of a connection structure of an electronic component and terminal metal fittings according to an embodiment of the present invention.
Figure 2:
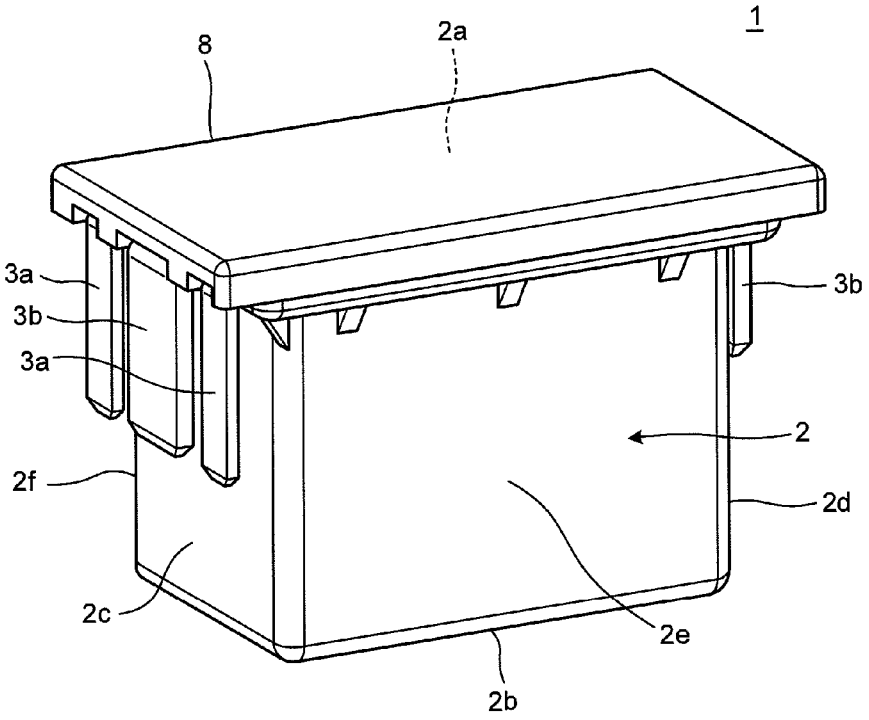
FIG. 2 is a perspective view of a relay illustrated in FIG. 1.
Figure 3:
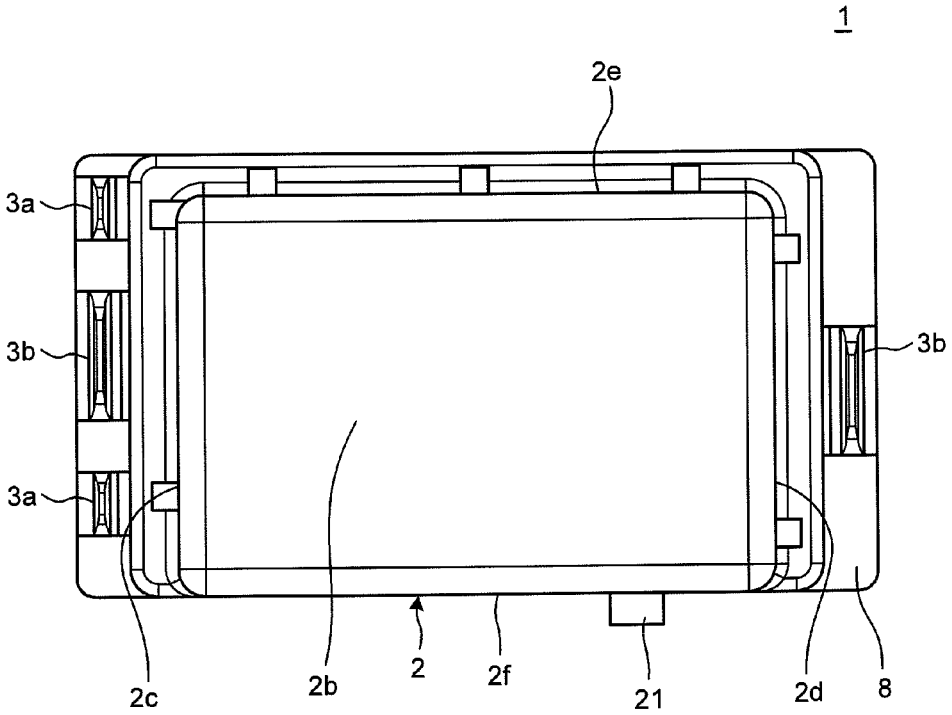
FIG. 3 is a bottom view of the relay illustrated in FIG. 2.
Figure 4:
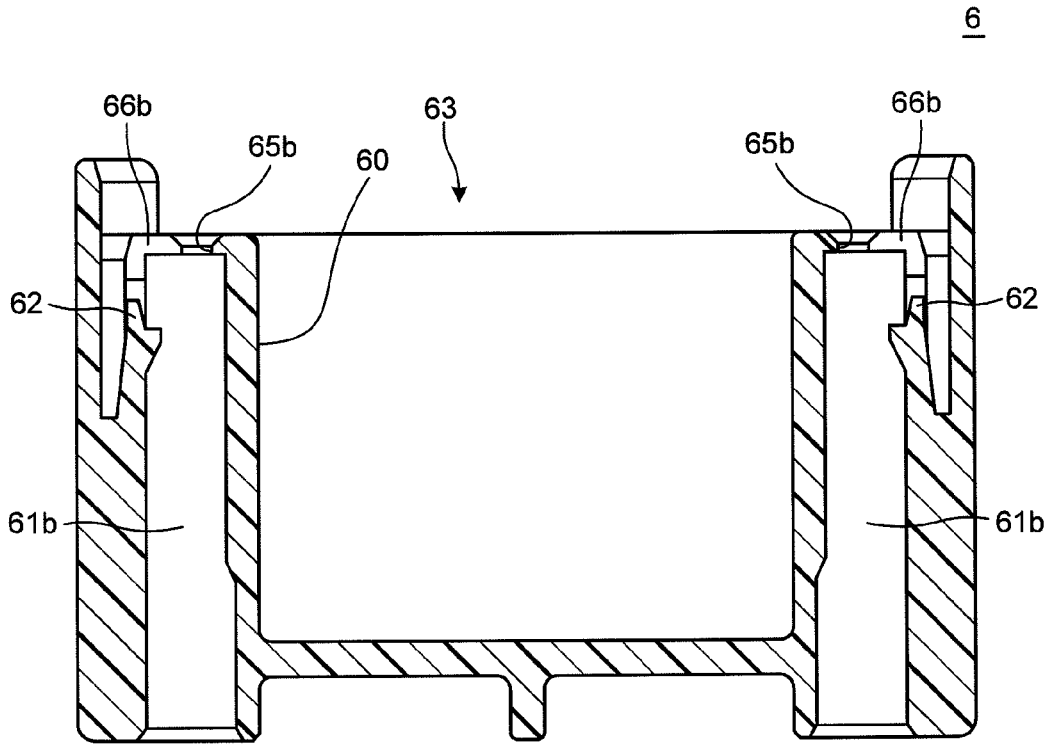
FIG. 4 is a sectional view of a holding member illustrated in FIG. 1.
Figure 5:
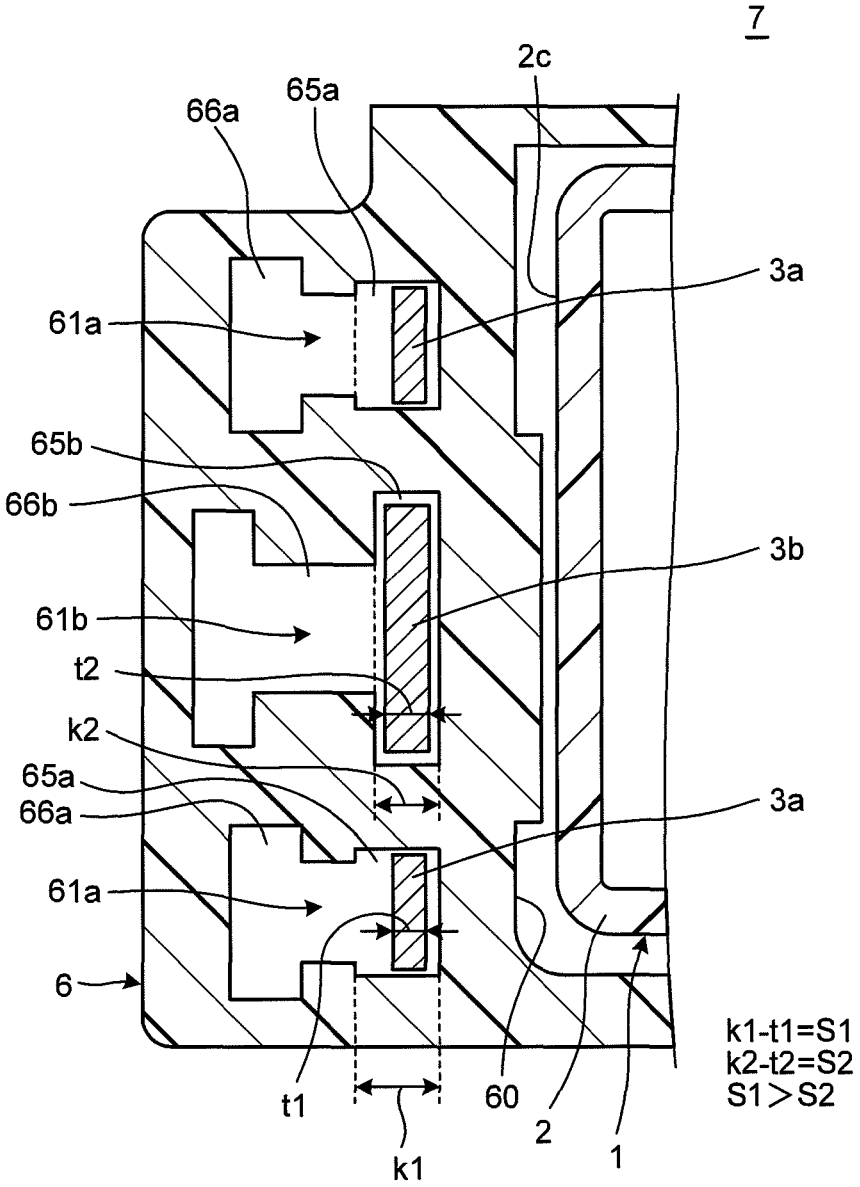
FIG. 5 is a sectional view taken along line A-A in FIG. 1.
Figure 6:
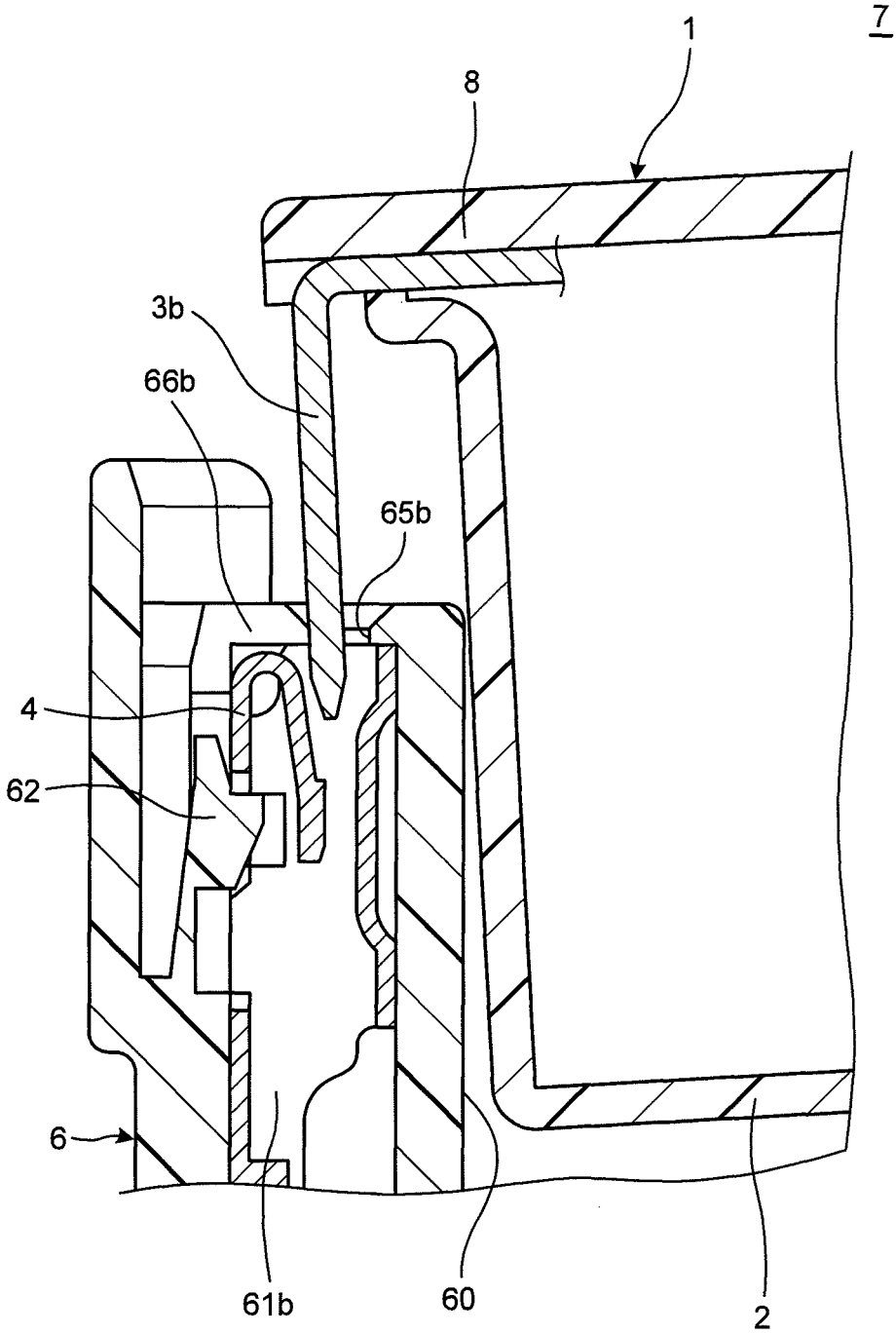
FIG. 6 is a diagram illustrating how the relay illustrated in FIG. 1 is inserted into the holding member.
Figure 7:
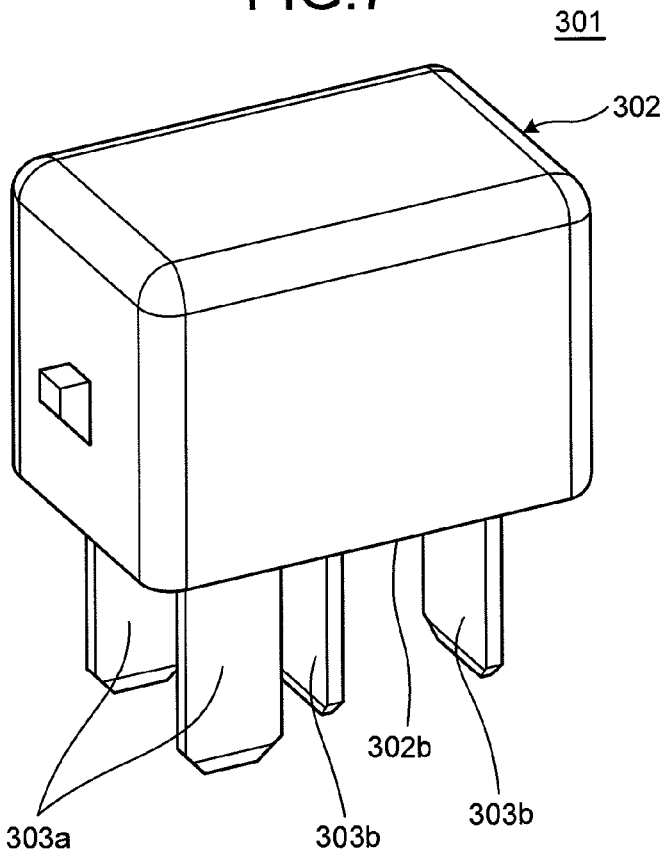
FIG. 7 is a perspective view of a conventional relay.
Figure 8:
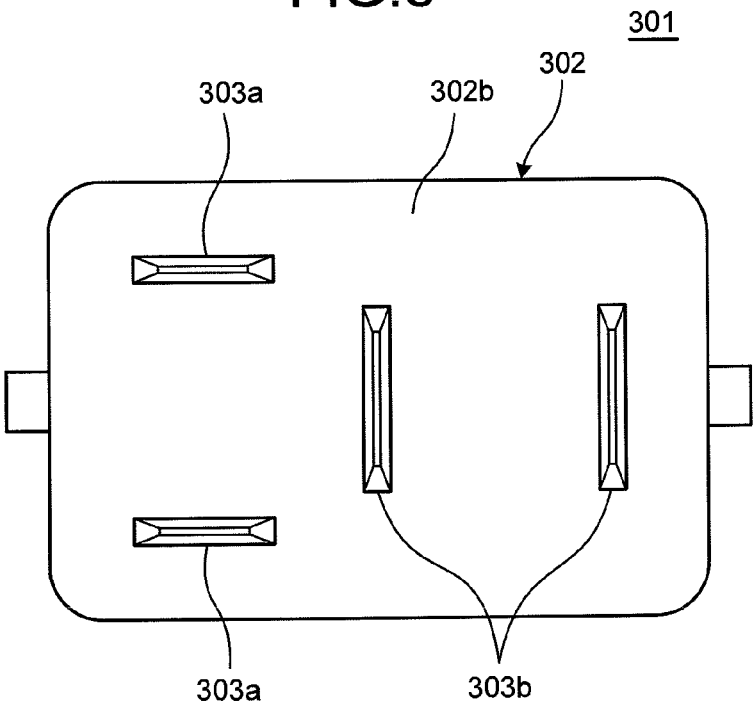
FIG. 8 is a bottom view of the relay illustrated in FIG. 7.
Figure 9:
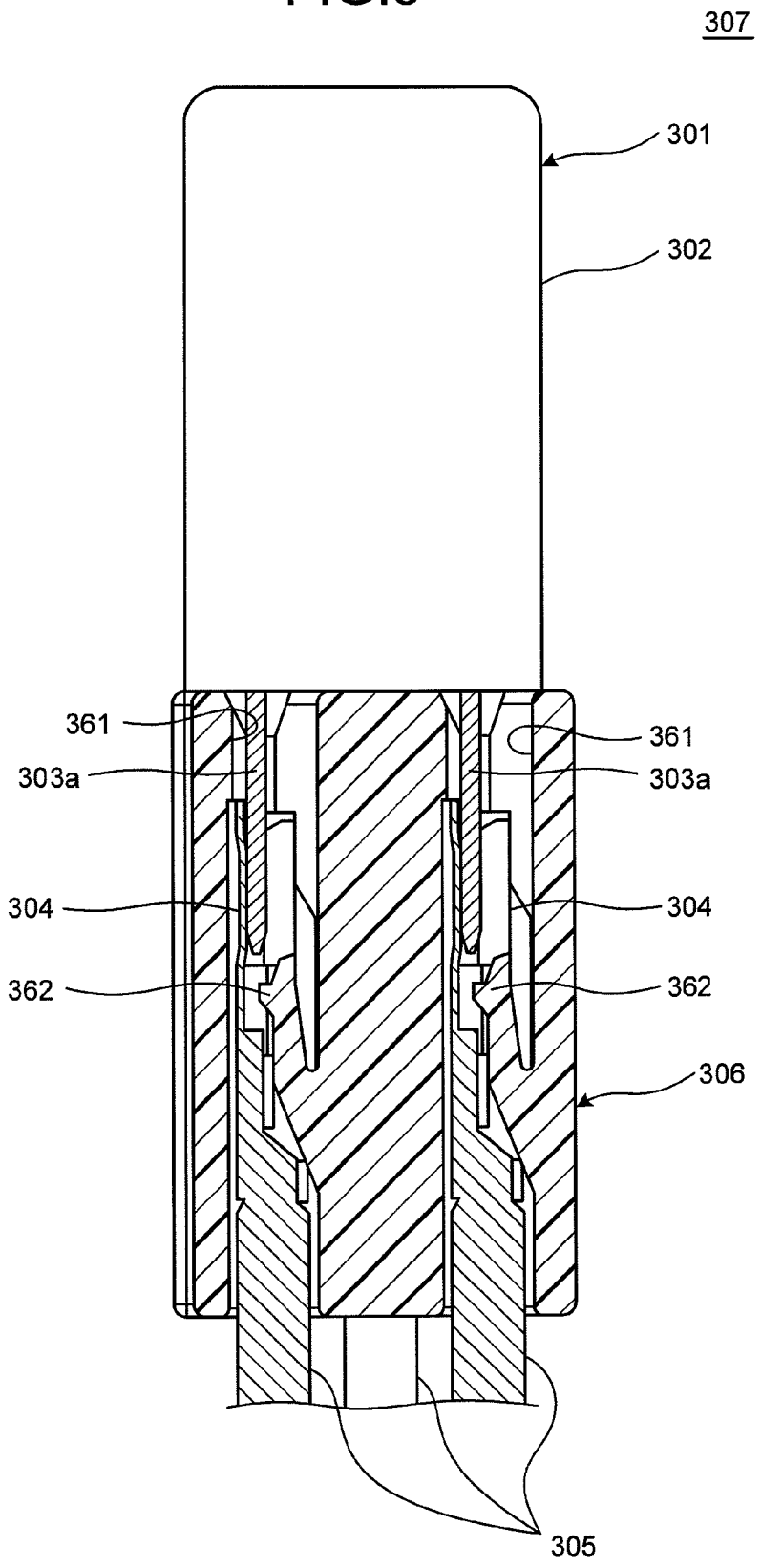
FIG. 9 is a sectional view of a connection structure of the relay illustrated in FIG. 7 and terminal metal fittings.

The following describes a "connection structure of an electronic component and terminal metal fittings" according to an embodiment of the present invention with reference to FIGS. 1 to 6. A connection structure 7 of an electronic component and terminal metal fittings illustrated in FIG. 1 is used for, for example, an electrical connection box for automobiles. The connection structure 7 of an electronic component and terminal metal fittings includes a relay 1 ("electronic component" in Claims) including a relay body 2 ("component body" in Claims) having a rectangular parallelepiped outer shape and a plurality of terminals 3*a* and 3*b* protruding from the relay body 2, a plurality of terminal metal fittings 4 mating with the corresponding terminals 3*a* and 3*b*, and a holding member 6 that accommodates the relay 1 and the terminal metal fittings 4. FIGS. 1 and 6 omit drawings of various parts accommodated inside the relay body 2. FIGS. 1 and 4 are sectional views taken along the longitudinal direction of two terminal accommodating portions 61*b* to be described later.

As described above, the relay 1 includes the relay body 2 having a rectangular parallelepiped outer shape. As illustrated in FIGS. 2 and 3, the relay body 2 has a top surface 2*a* and a bottom surface 2*b* facing each other, side surfaces 2*c* and 2*d* facing each other, and side surfaces 2*e* and 2*f* facing each other. As illustrated in FIG. 3, the side surface 2*f* has an engaging protrusion 21 that engages the holding member 6. The relay 1 includes a plate-like resin member 8 that holds the terminals 3*a* and 3*b* and is mounted on the top surface 2*a*. The resin member 8 holds the terminals 3*a* and 3*b* by insert molding or engaging structure.

The terminals 3*a* and 3*b* are made of metal plate and are held by the resin member 8 as described above. Base portions of the terminals 3*a* and 3*b* are electrically connected to a conductor inside the relay body 2. Middle portions of the terminals 3*a* and 3*b* are bent on a surface of the resin member 8 at right angles toward the bottom surface 2*b* of the relay body 2. End portions of the terminals 3*a* and 3*b* face the side surfaces 2*c* and 2*d*. The end portions of the terminals 3*a* and 3*b* mate with connection parts 41 of the terminal metal fittings 4 to be described later. The leading ends of the terminals 3*a* and 3*b* are positioned closer to the top surface 2*a* side than the bottom surface 2*b* of the relay body 2.

The terminals 3*a* and 3*b* are four terminals in total, three of which face the side surface 2*c* and the remaining one of which faces the side surface 2*d*. Specifically, two terminals 3*a* and a terminal 3*b* face the side surface 2*c* and the remaining terminal 3*b* face the side surface 2*d*. The two terminals 3*a* facing the side surface 2*c* are disposed at both sides of the terminal 3*b*. All the leading ends of the terminals 3*a* and 3*b* are aligned along the same height position.

The terminals 3*a* are terminals that energize a coil inside the relay body 2, and the terminals 3*b* are terminals to which a higher voltage or a larger current than that of the terminals 3*a* is applied. Hereinafter, the terminals 3*a* are referred to as first terminals 3*a* and the terminals 3*b* are referred to as second terminals 3*b*. The second terminals 3*b* have a larger width and thickness than those of the first terminals 3*a*. With this configuration, the second terminals 3*b* are more rigid than the first terminals 3*a*.

The terminal metal fittings 4 are made by, for example, presswork on a metal plate, and are connected to the corresponding ends of wires 5. Each terminal metal fitting 4 includes a female connection part 41 that mates with the terminal 3*a* or 3*b*, a crimping piece 42 that caulks the core wire uncovered from insulating coating and exposed at an end portion of a wire 5, and a crimping piece 43 that caulks a portion covered by the insulating coating (FIG. 1). The connection part 41 includes a pipe portion 44 in which the terminal 3*a* or 3*b* is positioned, and a spring 45 that presses inward the terminal 3*a* or 3*b* positioned in the pipe portion 44. In the context of the present invention, other terminal metal fittings than the terminal metal fittings 4 can also be used, such as terminal metal fittings having a Faston shape or terminal metal fittings having a tuning-fork shape.

The holding member 6 is made of a synthetic resin. The holding member 6 includes one or more relay accommodating portions 63 and engaging portions (not illustrated) that engage a case of a component such as the electrical connection box. As illustrated in FIGS. 4 and 5, such a relay accommodating portion 63 includes a component body accommodating portion 60 that accommodates the relay body 2, terminal accommodating portions 61*a* and 61*b* that accommodate the end portions of the terminals 3*a* and 3*b* and the terminal metal fittings 4, and lances 62 provided in the terminal accommodating portions 61*a* and 61*b* to engage the terminal metal fittings 4. The component body accommodating portion 60 has a recessed shape opening upward. The terminal accommodating portions 61*a* and 61*b* have a pipe-like shape opening both upward and downward. In this context, the word "downward" indicates the direction in which the relay 1 is inserted into the holding member 6. The word "upward" indicates the direction opposite to the inserting direction.

Hereinafter, the terminal accommodating portions 61*a* that accommodate the first terminals 3*a* are referred to as first terminal accommodating portions 61*a*. The terminal accommodating portions 61*b* that accommodate the second terminals 3*b* are referred to as second terminal accommodating portions 61*b*. The first terminals 3*a* are inserted into the first terminal accommodating portions 61*a* through insertion slots 65*a* illustrated in FIG. 5. Openings 66*a* in FIG. 5 are holes through which metal molds that mold the lances 62 were removed. Each insertion slot 65*a* is connected to a corresponding opening 66*a*. In the same manner, the second terminals 3*b* are inserted into the second terminal accommodating portions 61*b* through insertion slots 65*b* illustrated in FIGS. 4 and 5. Openings 66*b* in FIGS. 4 and 5 are holes through which metal molds that mold the lances 62 were removed. Each insertion slot 65*b* is connected to a corresponding opening 66*b*.

As illustrated in FIG. 5, a gap dimension S1 in the terminal thickness direction between the first terminal 3*a* and the insertion slot 65*a* of the first terminal accommodating portion 61*a* is larger than a gap dimension S2 in the terminal thickness direction between the second terminal 3*b* and the insertion slot 65*b* of the second terminal accommodating portion 61*b*. The "gap dimension S1 in the terminal thickness direction" is defined by subtracting a terminal thickness t1 of the first terminal 3*a* from a dimension k1 of the insertion slot 65*a* of the first terminal accommodating portion 61*a* in the terminal thickness direction. The "gap dimension S2 in the terminal thickness direction" is defined by subtracting a terminal thickness t2 of the second terminal 3*b* from a dimension k2 of the insertion slot 65*b* of the second terminal accommodating portion 61*b* in the terminal thickness direction.

The connection structure 7 of such an electronic component and terminal metal fittings is assembled such that, first, the terminal metal fittings 4 are connected to the end portions of the wires 5, and then the wires 5 with the terminal metal fittings are inserted into the first terminal accommodating portions 61*a* and the second terminal accommodating portions 61*b* from the bottom to cause the terminal metal fittings 4 to engage the lances 62. Subsequently, the relay 1 is inserted into the relay accommodating portion 63 of the holding member 6 from above to cause the terminals 3*a* and 3*b* to mate with the corresponding terminal metal fittings 4, thus completing the connection structure 7.

As illustrated in FIG. 6, the relay 1 is inserted into the relay accommodating portion 63 such that the relay body 2 enters the component body accommodating portion 60 before the terminals 3*a* and 3*b* enter the terminal accommodating portions 61*a* and 61*b*. This configuration roughly determines the positions of the terminals 3*a* and 3*b* relative to the corresponding terminal accommodating portions 61*a* and 61*b*. Thus, the connection structure 7 can prevent distortion or damage to the terminals 3*a* and 3*b* when the relay 1 is attached.

As described above, the connection structure 7 has the gap dimension S1 in the terminal thickness direction between the first terminal 3*a* and the insertion slot 65*a* of the first terminal accommodating portion 61*a* that is larger than the gap dimension S2 in the terminal thickness direction between the second terminal 3*b* and the insertion slot 65*b* of the second terminal accommodating portion 61*b*. This configuration prevents the first terminal 3*a* from hitting a nearby surface around the insertion slot 65*a* of the first terminal accommodating portion 61*a* if the second terminal 3*b* hits a nearby surface around the insertion slot 65*b* of the second terminal accommodating portion 61*b*. In other words, the connection structure 7 allows the second terminal 3*b* and the insertion slot 65*b* of the second terminal accommodating portion 61*b* to serve as a guide for the first terminal 3*a* to be inserted into the insertion slot 65*a* of the first terminal accommodating portion 61*a*. Thus, the connection structure 7 can more securely protect the first terminal 3*a* that is less rigid than the second terminal 3*b*.

As described in Claims, a "gap dimension between the first terminal and an insertion slot of a first terminal accommodating portion" and a "gap dimension between the second terminal and an insertion slot of a second terminal accommodating portion" include dimensions in two directions that are the "gap dimensions (which are the gap dimensions S1 and S2) in the terminal thickness direction" and "gap dimensions in the terminal width direction". In the context of the present invention, gap dimensions in at least one direction of the two directions meet the condition described above.

In the above embodiment, the first terminals 3*a* differ from the second terminals 3*b* in rigidity by their different width and thickness. In some embodiments, the present invention includes first terminals and second terminals that have the same thickness but have different widths. In other embodiments, the present invention includes first terminals and second terminals that have different rigidity by their different materials, not by their sizes. For example, the second terminals are made of a material that is more rigid than the material of the first terminals.

Although, in the above embodiment, the two first terminals 3*a* and one second terminal 3*b* face the side surface 2*c* of the relay body 2, at least one first terminal and at least one second terminal face a side surface of the relay body in the present invention. Although, in the above embodiment, the two first terminals 3*a* are disposed at both sides of a second terminal 3*b*, the arrangement order of the first terminals 3*a* and the second terminal 3*b* is not limited to this in the present invention. For example, the second terminal 3*b* may be disposed in an endmost position, not in the center position.

The above embodiment is presented in a representative form of the present invention, and thus, is not intended to limit the scope of the present invention. In other words, the connection structure 7 according to the present invention may be modified in various other forms without departing from the scope of the present invention.

The connection structure according to the present invention includes a plurality of terminals (for example, terminals protruding from the component body and bending at right angles) having end portions facing side surfaces of the component body, and the leading ends of the end portions are positioned closer to the top surface than the bottom surface of the component body. This configuration allows the component body to enter the component body accommodating portion before the terminals enter the terminal accommodating portions when the electronic component is attached to the holding member, and the positions of the terminals are roughly determined relative to the corresponding terminal accommodating portions. Thus, this connection structure can prevent distortion or damage to the terminals when the electronic component is attached. The connection structure has a larger gap dimension between the first terminal and the insertion slot of the first terminal accommodating portion that accommodates the first terminal than a gap dimension between the second terminal and the insertion slot of the second terminal accommodating portion that accommodates the second terminal. This configuration prevents the first terminal from hitting a nearby surface around the insertion slot of the first terminal accommodating portion if the second terminal hits a nearby surface around the insertion hole of the second terminal accommodating portion. Thus, the connection structure can more securely protect the first terminal that is less rigid than the second terminal.

The connection structure may include the second terminal having a larger width than a width of the first terminal, which protects, in particular, the first terminal. This configuration allows the first and the second terminals to have most suitable sizes for the voltage values and current values to be applied to the respective terminals.

The connection structure may include the second terminal made of a material more rigid than a material of the first terminal, which protects, in particular, the first terminal. This configuration allows the first and the second terminals to be composed of most suitable materials for the voltage values and current values to be applied to the respective terminals.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection structure of an electronic component and terminal metal fittings, comprising:

an electronic component including a component body having a rectangular parallelepiped outer shape, and a plurality of terminals that have end portions facing side surfaces of the component body, the end portions having leading ends positioned closer to a top surface side than a bottom surface of the component body;

a plurality of terminal metal fittings configured to mate with the corresponding terminals; and a holding member in which the electronic component and the plurality of terminal metal fittings are accommodated, wherein two or more terminals of the terminals facing a side surface of the component body include a first terminal and a second terminal that is more rigid than the first terminal, the holding member includes a component body accommodating portion that accommodates the component body, and terminal accommodating portions that accommodate the end portions of the terminals and the terminal metal fittings, and a gap dimension between the first terminal and an insertion slot of a first terminal accommodating portion in which the first terminal is accommodated is larger than a gap dimension between the second terminal and an insertion slot of a second terminal accommodating portion in which the second terminal is accommodated.

2. The connection structure of an electronic component and terminal metal fittings according to claim 1, wherein the plurality of terminals protrude from the component body and bend in right angles.

3. The connection structure of an electronic component and terminal metal fittings according to claim 2, wherein a width of the second terminal is formed larger than a width of the first terminal.

4. The connection structure of an electronic component and terminal metal fittings according to claim 2, wherein the second terminal is made of a material that is more rigid than a material of the first terminal.

5. The connection structure of an electronic component and terminal metal fittings according to claim 1, wherein a width of the second terminal is formed larger than a width of the first terminal.

6. The connection structure of an electronic component and terminal metal fittings according to claim 5, wherein the second terminal is made of a material that is more rigid than a material of the first terminal.

7. The connection structure of an electronic component and terminal metal fittings according to claim 1, wherein the second terminal is made of a material that is more rigid than a material of the first terminal.

* * * * *